United States Patent [19]

Goldstein

[11] Patent Number: 4,640,100

[45] Date of Patent: Feb. 3, 1987

[54] REFRIGERATION SYSTEM

[75] Inventor: Vladimir Goldstein, Concord, Canada

[73] Assignee: Sunwell Engineering Company Limited, Woodbridge, Canada

[21] Appl. No.: 691,631

[22] Filed: Jan. 15, 1985

[51] Int. Cl.[4] ..... F25B 43/00

[52] U.S. Cl. ..... 62/197; 62/117; 62/512

[58] Field of Search ..... 62/220, 117, 512, DIG. 2, 62/509, 197

[56] References Cited

U.S. PATENT DOCUMENTS

| | | | |
|---|---|---|---|
| 3,067,590 | 12/1962 | Wood, Jr. | 62/DIG. 2 |
| 3,744,273 | 7/1973 | Ware | 62/512 |
| 4,096,706 | 6/1978 | Beckwith | 62/509 |

*Primary Examiner*—William E. Wayner

*Attorney, Agent, or Firm*—McCarthy & McCarthy

[57] ABSTRACT

A refrigeration system includes a heat rejection loop and a heat absorbtion loop interconnected by a phase separation device. Refrigerant is circulated in the heat rejection loop by a positive displacement pump thereby permitting the pressure of refrigerant in the condensor to fluctuate as the ambient temperature fluctuates. This increases the capacity of the system and reduces the work performed by the compressors. A bypass line is provided between the phase separation device and the condensor to allow the compressors to be switched off completely when the ambient temperature is below the evaporator temperature. The output of the compressors is also used as a heat source to defrost the evaporators as required.

18 Claims, 1 Drawing Figure

REFRIGERATION SYSTEM

Figure 1:
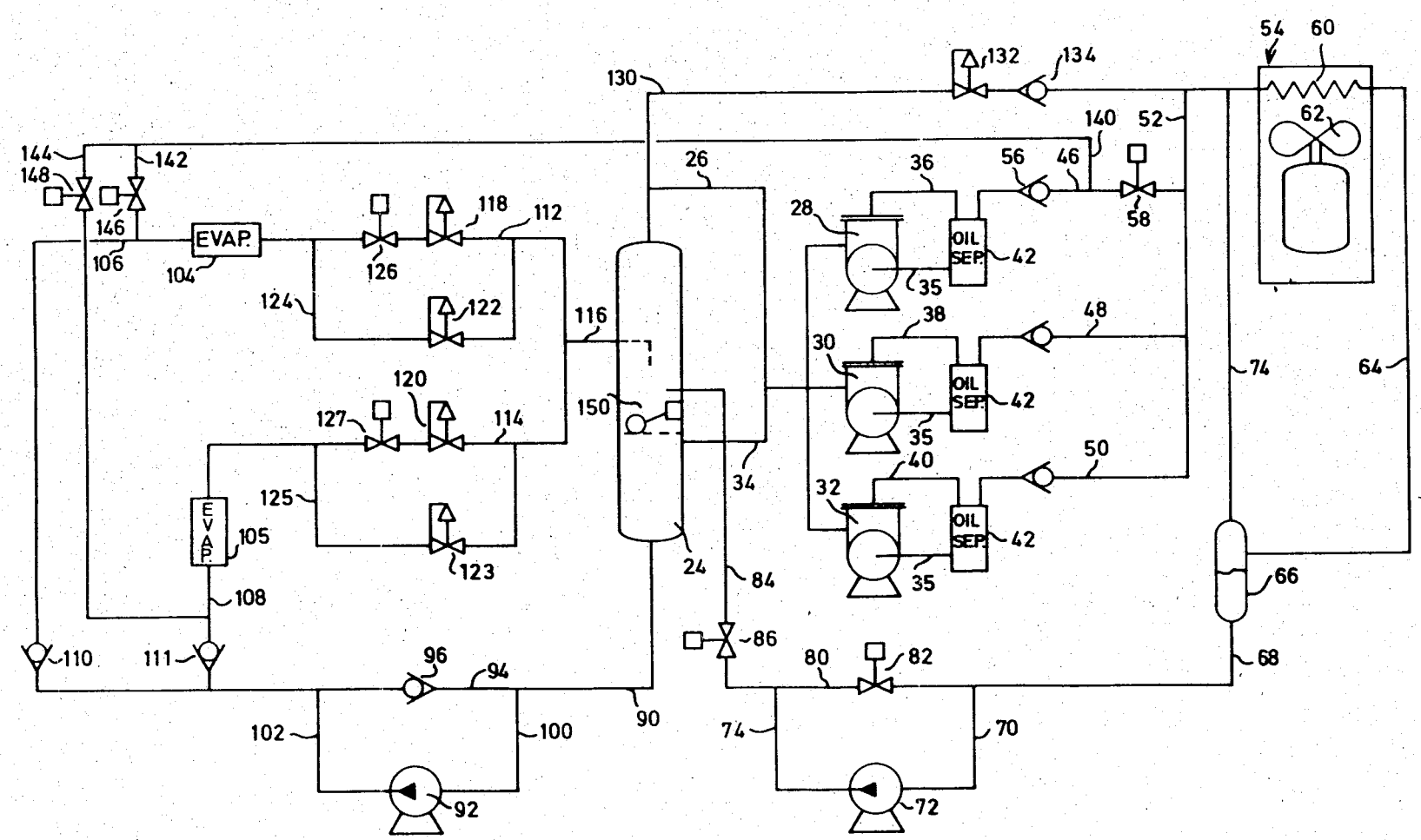

The present invention relates to refrigeration systems.

Refrigeration systems are widely used in industry to and maintain selected areas of a plant at a uniform temperature. Such systems conventionally have a compressor that supplies refrigerant to a condenser where heat is rejected to the atmosphere. The condensed refrigerant is then expanded through an expansion valve and circulated through an evaporator to absorb heat from the environment by means of a phase change. The vapour of the refrigerant is then recirculated through the compressor to repeat the cycle.

This systems is relatively efficient and generally accepted, but because of the use of the expansion valve it is necessary to maintain a large pressure differential between the heat rejection and heat absorption loops of the circuit. Because of the need to maintain this high pressure differential the temperature of the condenser must be maintained relatively constant so that as the ambiant temperature varies steps must be taken to vary the heat rejection effect of the condenser. In certain climates such as the northern latitudes this may result in the condenser being shielded from the outside air even though the ambiant temperature is below the temperature that is being maintained by the evaporator. If the temperature of the condenser is allowed to vary with the ambiant temperature, the pressure in the condenser will also vary and the flow rate through the evaporator valve will be adversely effected.

The current systems as described above therefore are unable to take advantage of changes in ambiant temperature to decrease the power consumption of the refrigeration system.

It is therefore an object of the present invention to provide a system in which the above disadvantages are obviated or mitigated.

According therefore to the present invention there is provided a refrigeration system comprising a first phase separation device containing a supply of refrigerant in liquid and vapour phases, a compressor to withdraw refrigerant in the vapour phase from said supply and compress it, a condenser means to condense the refrigerant supplied by said compressor, second phase separation means to segregate liquid and vapour phases of said refrigerant delivered from said condenser, liquid pump means to transfer liquid refrigerant from said phase separation means through expansion means to said first phase separation means, evaporator means to receive liquid refrigerant from said second phase separation means and pump means to circulate refrigerant through said evaporator and return it to said first phase separation device.

By providing liquid pumping means in the heat rejection portion of the refrigeration apparatus, it is possible to circulate the refrigerant at the required flow rate whilst allowing the pressure within the condenser to vary as the ambiant temperature varies.

Preferaby further advantage is taken of the ability to allow the condenser to operate at ambiant temperatures by providing a bypass line that allows vapour to be fed directly to the condenser independently of the compressor operations so that the compressors may be switched off when a significant differential temperature exists between the ambiant and the temperature being maintained by the evaporator.

According also to the present invention there is provided a refrigeration system comprising a first phase separation to maintain a supply of refrigerant in a vapour and liquid phase, a heat rejection circuit connected to said phase separation device and including a compressor to withdraw and compress refrigerant from said first phase separation device, a condenser to condense vapour delivered by said compressor and a return conduit including expansion means to return condensate to said phase separation device, a heat absorption circuit connected to said phase separation device and including an evaporator to receive liquid refrigerant from said first phase separation device and transfer heat thereto and transfer means to transfer refrigerant from the output of said compressor to said evaporator to effect defrost thereof.

An embodiment to the invention will now be described way of example only with reference to the accompanying drawing which illustrates schematically the components of a refrigeration system and the interconnetion of those components.

Referring to the drawing the refrigeration system comprises a heat rejection loop 20 and a heat absorption loop 22. The two loops are interconnected at a phase separation device 24 that acts as a supply of refrigerant for the two loops of the system. Refrigerant is stored in the phase separation device 24 in liquid and vapour phases. The vapour phase is withdrawn through a compressor supply line 26 to the inlet of one of three compressors 28, 30, 32. A drain line 34 is located between the supply line 26 and the phase separation device 24 to allow liquid refrigerant to drain back to phase separation device.

Each of the compressors 28, 30, 32 has a high pressure outlet line 36, 38, 40 respectively. Each of the outlet lines pass through an oil separator 42 that feeds oil back to the compressors through a recirculation line 35.

Each of the oil separators 42 delivers compressed vapour through branch conduits 46, 48, 50 to the main supply line of 52 of a condensor 54. A check valve 56 is located in each of the branch conduits with the conduit 48 including a motor operated valve 58 downstream of the check valve 56.

The condensor 54 comprises a heat exchanger 60 through which refrigerant flows and a fan 62 to blow air over the heat exchanger. The condensor is a well-known construction typically an RACC334D8 condensor.

After passing through the condensor 54 refrigerant is delivered through a condensate supply line 64 to a second phase separation device 66. The phase separation device 66 separates the vapour and liquid phases of the condensate and delivers liquid refrigerant through conduit 68 to the inlet 70 of a positive displacement liquid pump 72. A pressure equalising line 74 is connected between the condensate supply line 52 and the vapour side of the phase separation device 66 to ensure constant pressure across the condensor.

The liquid pump 72 is a gear pump that will deliver a fixed volume per revolution between the inlet 70 and its outlet 74. A bypass line 80 is provided between the inlet 70 and outlet 74 and a motor operated flow control valve 82 is located in the bypass line 80.

The outlet of the pump 72 is connected through line 84 to the interior of the phase separation device 24 above the level of liquid in that device. The inlet of line 84 to the device 24 acts as a expansion valve and allows the refrigerant to expand and separate into liquid and vapour phases within the device 24. A control valve 86 is located in the line 84 to regulate the flow through the line.

Liquid in the device 24 is removed through evaporator feed line 90 and passes through a refrigerant circulation pump 92. A bypass line 94 including a check valve 96 is provided between in inlet 100 and outlet 102 respectively of the pump the 92. The outlet 102 is connected to a pair of evaporators 104, 105 through branch conduits 106, 108 respectively. Check valves 110, 111 are located in respective ones of conduits 106, 108 to prevent reverse flow of refrigerant in the evaporators. The output of the evaporators 104, 105 is passed through return lines 112, 114 into a main return line 116 and to the interior of the phase separation device 24. Each of the return lines 112, 114 includes a pilot operated pressure requlating valve 118, 120 respectively to control the pressure within the evaporators 104, 105.

A second pressure regulator 122, 123 is connected in parallel to the pressure requlating valves 118, 120 respectively by means of a bypass lines 124, 125. Motor operated control valves 126, 127 are located between the bypass line 124, 125 and their respective pressure regulating valves 118, 120 to control flow throuqh the bypass lines 124, 125.

A compressor bypass line 130 is connected between the compressor supply line 26 and the condensor supply line 52. Located in the compressor bypass line 130 is a pressure regulator valve 132 and a check valve 134.

A defrost line 140 is connected to the branch conduit 46 between the check valve 56 and the motor operated valve 58. The defrost line 140 conveys fluid to the conduits 106, 108 through branch lines 142, 144 respectively. Located in respective the branch lines 142, 144 are motor operated valves 146, 148 so that the defrost line 140 can be connected with a selected one of the evaporators 104, 105. The branch conduits 142, 144 are connected to the conduits 106, 108 between the check valves 110, 111 and the evaporators 104, 105. In this way refrigerant in the defrost line does not circulate to the other evaporator.

The level of liquid refrigerant within the phase separation device 24 is controlled by a float valve 150 that controls the flow rate of the pump 72. Upon the level of refrigerant in the phase separation device 24 attaining the predetermined level, and appropriate control signal is sent to the control valves 82 and 86 so that they are adjusted to allow re-circulation of the fluid between the outlet and inlet of the pump 72.

Under normal operation, the compressors 28, 30, 32 receive vapour through the compressor supply line 26 and deliver it through the oil separators 42 to the branch conduits 46, 48, 50. The motor operated valve 58 is open and the valves 146, 148 closed so that flow is not permitted through the defrost line 140. The check valve 134 prevents reverse flow of refrigerant through the bypass line 130 to the phase separation device 24. The output of the compressors is therefore delivered to the condensor 54 through the supply line 52 where the air blown by the fan 62 over the heat exchanger 60 rejects heat from the refrigerant. The condensate that is then delivered to the phase separation device 66 where the liquid collects and is delivered to the inlet of the pump 72. The valves 82 and 86 are adjusted so that the level of liquid refrigerant in the interior of the phase separation device 24 is maintained at the desired level. As the refrigerant is delivered to the interior of the phase separation device 24 it expands to a lower pressure and is separated into a vapour and liquid phases. The liquid is delivered by the pump 92 to the evaporators 104, 105 where heat is absorbed from the surroundings through a change of phase of the refrigerant. The control valves 126, 127 are open to allow flow through the pressure regulating valves 118, 120 to return to the interior of the phase separation device. Again the liquid and vapour phases of the refrigerant are separated within the device. Thus, heat is rejected in the condensor and absorbed in the evaporators through the circulation of refrigerant.

As the ambient temperature varies, the pressure in the condensor will also vary. However, the flow rate of refrigerant through the heat rejection loop 20 of the system is maintained by the pump 72 to maintain the supply of refrigerant to the phase separation device 24. As the condensor temperature reduces with the reduction in the ambiant temperature the capacity of the system increases because of the improved efficiency of the heat exchanger and the power consumption of the compressor decreases simultaneously. This in turn enables the system to be operated with fewer compressors so that one or more of the compressors can be switched off. If necessary the heat rejection of the condensor may be controlled by modulation of the fan 60. If the ambiant temperature drops below the evaporator temperature by a significant amount, typically 9° C., the compressors may be switched off completely. When this occurs flow of refrigerant from the phase separation device 24 migrates through the bypass line 130 to the condensor 54. Circulation of the refrigerant is maintained by the pump 72. The pressure regulator 132 offers a minimum restriction to flow, but is operative to maintain the pressure in the phase separation device 24 constant. This is important to maintain the evaporation temperature constant in the heat absorption loop.

The modulation of the condensor pressure and reduction in compressor work provides substantial energy savings over the course of a year by taking full advantage of the ambient temperature for cooling whilst maintaining control of the evaporator temperature.

Because of the build up of ice on the evaporators 104, 105 it is necessary periodically to defrost them. To achieve defrost of the evaporators the valve 58 is closed and the one of the valves 146 or 148 associated with the evaporator to be defrosted is opened. The high temperature and high pressure vapour in the branch conduit 46 is delivered through the defrost line 140 to the evaporator to heat it and melt the ice build up on the evaporator.

The valve 126 is closed so that flow is regulated by the pressure regulating valve 122 in the bypass conduit 124. The circulation of hot vapour through the evaporator 104 continues for a predetermined period until the ice has been melted.

A similar defrost operation can then be undertaken on the other of the evaporators 105 by opening the control valves 148. When the defrost operation has been completed the control valves 148 is closed and the valve 58 opened to allow the output of the compressor 28 through the condensor in the normal manner. It will be observed that during the defrost operation it is possible to maintain the circulation of refrigerant through the evaporators and through the condensor by use of the other compressors.

The number of compressors and the capacity of the evaporators and condensors will of course be determined by the plant that is to be installed and the operational requirements of that plant. However, certain basic design considerations should be taken into account. The pressure regulator in the bypass line 130 must be sized to give minimal restriction to the flow, as high differential pressure cannot be tolerated.

For the vapour refrigerant to migrate from the high pressure evaporator to the low pressure condenser, the respective pressure drop produced by frictional losses, through pipes, valves, fittings, bends, etc., must be overcome. The bypass line should be sized to permit a low pressure drop while the size of the pipe should be minimal in order to reduce the capital cost of valves and fittings. The most feasible pipe size can be determined by comparing the pressure drop with respect to different pipe diameters, and the corresponding capital cost for each pipe size.

I claim:

1. A refrigeration system comprising a first phase separation device containing a supply of refrigerant in liquid and vapour phases, a compressor to withdraw refrigerant in the vapour phase from said supply and compress it, condenser means to condense the refrigerant supplied by said compressor, second phase separation means to segregate liquid and vapour phases of said refrigerant delivered from said condenser, liquid pump means to transfer liquid refrigerant from said phase separation means through expansion means to said first phase separation means, evaporator means to receive liquid refrigerant from said second phase separation means and pump means to circulate refrigerant through said evaporator and return it to said first phase separation device.

2. A refrigeration system according to claim 1 wherein a bypass line is provided between said first phase separation device and said condensor to permit transfer of refrigerant therebetween independently of operation of said compressor.

3. A refrigeration system according to claim 2 wherein a check valve is located in said bypass line to prevent transfer of refrigerant therethrough when said compressor is operating.

4. A refrigeration system according to claim 2 wherein pressure regulating means are located in said bypass line to maintain a predetermined pressure in said first phase separation device.

5. A refrigeration system according to claim 4 wherein unidirectional flow control means is located in said bypass line to inhibit flow of refrigerant from said compressor through said bypass line to said first phase separation device.

6. A refrigeration system according to claim 1 wherein liquid level sensing means are provided in said first phase separation device to monitor the level of fluid therein and control the flow of refrigerant from said condensor to said first phase separation device.

7. A refrigeration system according to claim 6 wherein said liquid level sensing means regulates valves to recirculate a portion of the output of said liquid pump to the input thereof.

8. A refrigeration system according to claim 1 including means to divert refrigeration from the output of said compressor to said evaporator to defrost the evaporator.

9. A refrigeration system, according to claim 8 wherein said means to divert includes a refrigerant conduit, a first valve operable to control flow from said compressor to said condensor, a second valve operable to control flow through said refrigerant conduit, and control means to control operation of said valve means, said control means operating to close said first valve and open said second valve to effect defrost of said evaporator.

10. A refrigeration system according to claim 9 wherein a plurality of evaporators are connected to said refrigerant conduit and a second valve is provided for each evaporator to permit defrost of one of said evaporators independently of the operation of the others.

11. A refrigeration system according to claim 10 wherein said compressor includes a plurality of units each of which is connected to said condensor and said first valve is operable to divert flow of selected ones of said units.

12. A refrigeration system according to claim 10 wherein a pressure regulating valve is associated with each of said evaporators to maintain pressure during operation of said evaporators and valve means are provided to isolate said pressure regulator upon defrosting of said evaporator.

13. A refrigeration system according to claim 12 wherein said valve means isolates said pressure regulator upon said second valve moving to an open position.

14. A refrigeration system according to claim 13 wherein a second pressure regulator is associated with each of said evaporators and operates to control the pressure of refrigerant during defrosting of said evaporator.

15. A refrigeration system comprising a first phase separation device to maintain a supply of refrigerant in a vapour and liquid phase, a heat rejection circuit connected to said phase seapration device and including a compressor to withdraw and compress refrigerant from said first phase separation device, a condenser to condense vapour delivered by said compressor and a return conduit including expansion means to return condensate to said phase separation device, a heat absorption circuit connected to said phase separation device and including an evaporator to receive liquid refrigerant from said first phase separation device and transfer heat thereto, transfer means to transfer refrigerant from the output of said compressor to said evaporator to effect defrost thereof and bypass means connected between said first phase separation device and said condenser to permit transfer of refrigerant therebetween independently of the operation of the compressor, said bypass means including a pressure regulating valve to maintain the pressure within said first phase separation device at a predetermined level.

16. A refrigeration system according to claim 15 wherein a second phase separation device is located in said return conduit between said condenser and said expansion means and liquid pump means transfer refrigerant from said second phase separation device to said expansion means.

17. A refrigeration system according to claim 16 wherein said evaporator includes a plurality of evaporation units and said transfer means is effective to transfer refrigerant to selected ones of said units.

18. A refrigeration system according to claim 17 wherein pressure regulating means are associated with each of said evaporator units to maintain a predetermined pressure therein.

* * * * *